US006669399B2

(12) United States Patent
Janek, Jr.

(10) Patent No.: US 6,669,399 B2
(45) Date of Patent: Dec. 30, 2003

(54) WEDGE-LOCKABLE REMOVABLE PUNCH AND DIE BUSHING IN RETAINER

(75) Inventor: Francis Richard Janek, Jr., Chardon, OH (US)

(73) Assignee: WedgeLock Systems, Ltd., Carson City, NV (US)

( * ) Notice: Subject to any disclaimer, the term of this patent is extended or adjusted under 35 U.S.C. 154(b) by 143 days.

(21) Appl. No.: 09/777,482

(22) Filed: Feb. 5, 2001

(65) Prior Publication Data

US 2001/0020410 A1 Sep. 13, 2001

Related U.S. Application Data

(63) Continuation-in-part of application No. 09/351,730, filed on Jul. 12, 1999, now Pat. No. 6,182,545.

(51) Int. Cl.[7] ..... B25G 3/20; F16B 2/14; F16B 2/18; F16B 7/04

(52) U.S. Cl. ..... 403/374.2; 403/374.3; 83/698.11

(58) Field of Search ..... 403/374.1, 374.2, 403/373, 374.3, 374.4, 379.4, 355, 356, 314, 315–319, 367; 279/28; 83/679, 684, 685, 698.31, 698.11, 651

(56) References Cited

U.S. PATENT DOCUMENTS

| | | | | | |
|---|---|---|---|---|---|
| 2,662,773 | A | | 12/1953 | Parsons | 279/30 |
| 3,055,463 | A | * | 9/1962 | Lutz | |
| 3,137,193 | A | | 6/1964 | Whistler et al. | 83/685 |
| 3,535,967 | A | | 10/1970 | Whistler et al. | 83/698 |
| 3,572,785 | A | * | 3/1971 | Larson | |
| 4,167,355 | A | * | 9/1979 | Hansson | 403/374 |
| 4,187,035 | A | * | 2/1980 | Colburn | 403/374 X |
| 4,282,665 | A | * | 8/1981 | Fletcher et al. | 403/374 X |
| 4,486,116 | A | * | 12/1984 | Sassi | 403/367 |
| 4,663,867 | A | * | 5/1987 | Hahn et al. | 403/374 X |
| 4,925,142 | A | * | 5/1990 | Farmer | 403/374 X |
| 4,979,724 | A | * | 12/1990 | Williams | 403/374 X |
| 5,078,063 | A | * | 1/1992 | Johansen et al. | 403/374 X |
| 5,134,793 | A | * | 8/1992 | Bierwith | 403/374 X |
| 5,417,518 | A | * | 5/1995 | Bierwith | 403/374 |
| 5,464,299 | A | | 11/1995 | Schärer et al. | 403/297 |
| 5,536,106 | A | * | 7/1996 | Landis et al. | 403/374 |
| 5,551,795 | A | * | 9/1996 | Engibarov | 403/381 |
| 5,881,625 | A | | 3/1999 | Wellman | 83/563 |
| 5,913,634 | A | | 6/1999 | Hellig | 403/374.1 |
| 5,964,547 | A | * | 10/1999 | Brinkley | 403/374.3 |
| 6,309,136 | B1 | * | 10/2001 | Kellenberger et al. | 403/374.3 |

FOREIGN PATENT DOCUMENTS

| | | |
|---|---|---|
| FR | 0446536 | 9/1991 |

* cited by examiner

*Primary Examiner*—Christopher J. Novosad
(74) *Attorney, Agent, or Firm*—Stevens & Showalter LLP

(57) ABSTRACT

A conventional ball lock mechanism has been replaced with a wedge adapted to lock a tool, such as a punch, forming tool or die bushing in a retainer block in which the tool can be accurately positioned relative to the retainer block. The tool is released by moving the wedge away from the retainer block. The inclined surface of the wedge may be inclined upward or downward at an acute angle to the vertical, or the wedge may have both upwardly and downwardly inclined surfaces. The upper portion of the tool is preferably non-circular and is held within a tool cavity formed when the wedge is disposed in the retainer block. One surface of the wedge (its tool-mating surface) is adapted to correspond to the surface of the tool in contact with the wedge. The assembly of wedge slidably disposed within the retainer block is preferably used with a hardened backing plate rather than being secured directly to the die shoe. Several embodiments for securing the wedge in the retainer block are described in each of which the wedge is vertically translatable. The preferred method for forming the wedge is to cut it from a block of hardened tool steel with a wire electric discharge machine.

7 Claims, 11 Drawing Sheets

WEDGE-LOCKABLE REMOVABLE PUNCH AND DIE BUSHING IN RETAINER

RELATED APPLICATION

This application is a continuation-in-part application of Ser. No. 09/351,730 filed Jul. 12, 1999, to issue as U.S. Pat. No. 6,182,545.

FIELD OF THE INVENTION

The present invention relates to an improvement in a retainer such as is conventionally used to secure a tool such as a punch, or, a die bushing (or die or die button), or forming tool, removably in a die shoe.

BACKGROUND OF THE INVENTION

A retainer for a punch (punch retainer) secures the punch held within it to a die shoe, usually the upper, of a punch press so that the punch may be moved downwards into a die bushing with precision, over and over again so that stringent specifications of a punched sheet may be maintained. The die bushing, in turn, is held in a retainer (die bushing retainer) and secured to an opposed die shoe of the punch press. Typically both the retainers are removably secured to their respective die shoes; and the punch and the die bushing are also removably secured in their respective retainers.

For several decades a "ball lock punch retainer" has been used to secure the punch, and in fewer instances, also the die bushing which is more often clamped to the lower die shoe of the press, or tightly fitted into a recess therein. Despite the many problems associated with the use of a spring-biased retaining ball biased against a helical spring held in an angulated elongated, passage within the retainer, this is the industrially favored mechanism because of the relatively low cost of manufacturing its components. However, aside from the relatively poor precision with which the shank (upper portion) of such a punch can be positioned, and the tolerable accuracy with which the point (lower portion) of the punch makes a through-passage ("hole" for brevity) of arbitrary cross-section in a sheet of stock being punched, a serious problem is that it is routinely an arduous and frustrating task to release a punch when it is to be replaced. One of the reasons is that repeated operation of the punch distorts the shape of the ball, which then becomes immovably lodged against the punch or against a helical spring against which the ball is biased. The problem of replacing the punch is worse when the ball is sheared, which typically happens when the stripping force (during withdrawal of the punch from the stock) exceeds that which the ball can withstand. In operation, punches are routinely subjected to unexpectedly large stripping forces typically cause by galling of the point.

An inherent result of using a ball seat or pocket in the shank of a punch to lock it with a ball is that, the shank of the punch is of necessity, cylindrical. If the point of the punch is non-circular in lateral cross-section, it can be sharpened only until the point is used up and the shank is reached. Moreover, by reason of the clearances required between the pocket and the ball, and the relatively small force exerted by the spring against the ball, it is difficult to maintain concentricity with tolerance less than 0.001 inch (0.0254 mm). Particularly when the shape of the hole to be punched is other than circular, the shank is not held tightly and non-rotatably in its elongated passage with the result that the play between the ball and the pocket results in slight but unacceptable variations in orientation of the hole punched. These problems are more readily envisioned by reference to FIGS. 1 and 2 in which the prior art mechanism is briefly described. Moreover, the structural differences and their effect on the forces exerted on a tool to be replaced, when compared to those of the present invention, will more readily be appreciated.

Similar considerations apply to securing a forming tool which operates in a forming press and which forming tool is typically secured in a manner analogous to a punch. A commonly used forming punch has a point for making the desired hole in a sheet of stock, and has an upwardly flared conical portion directly above the tip of the point. The flared portion serves to provide desired concavity. Hereafter, for brevity and convenience, a punch and a forming tool or forming punch, and a die bushing are together referred to by the term "tool"; and are identified individually when specifically referred to.

Referring to FIGS. 1 and 2, there is illustrated a retainer block indicated generally by reference numeral 10 and a conventional punch 20 held therein. A forming tool, if used, would be analogously held. The retainer block 10 includes a through-hardened backing plate 12 conforming to the upper surface of the retainer block, both being adapted to be secured to an upper die shoe of a punch press or other machine with a punching or forming function by suitable fastening means such as Allen-head screws (not shown). Since a tool (punch or forming) is generally used in a vertical attitude in a punch or forming press, the description herein refers to upper and lower in relation to such attitude. The retainer block 10 is provided with a cylindrical bore or tool socket 14 in which is slidably inserted and removably secured the shank (upper portion) 22 of the punch 20, the lower portion of which is an oval-shaped point 24. Block 10 is also provided with a cylindrical bore 15 which is angularly disposed relative to the bore 14 and which extends inwardly and downwardly into the retainer block 10 so as to partially intersect socket 14. The partial intersection occurs because the lower end of the bore 15 is provided with a stepped surface forming ball seat 13.

A retainer ball 16 is movably disposed in bore 15, and a helical compression spring 18 is snugly held in the bore 15 with one end abutting the backing plate 12 so as to urge the ball 16 outwardly of the intersecting portion of bore 15. Though the ball projects into the socket 14 the ball cannot escape (into the socket 14). The retainer block is also provided with a through-passage or release-hole 17 through which a thin rod or drift pin is inserted to push the ball upward and move it out of the ball seat 13 when the punch 20 is to be removed. To replace the ball 16 when it gets distorted or damaged, the retainer block 10 is removed from the backing plate 12 and the spring and ball removed through the top of bore 15.

The shank 22 is provided with a semi-pocket or ball seat 25 shaped generally like a one-half of a falling tear drop viewed in longitudinal elevation, and which is adapted to receive locking ball 16 to releasably lock the punch 20 in the bore 14. The pocket's upper portion 26 appears as a straight section forming a continuation of the bore 15; and the lower portion is provided with a return section 28 which is curved upon a radius greater than the radius of the ball 16 so as to connect the deepest part of the pocket 25 to the surface of the shank. When the ball 16 is held in pocket 25 its bottom may be in contact with the ball if the radius of section 28 is substantially greater than that of the ball; or, if the radius of the ball is substantially greater than that of the return section 28, the extreme edges 34, 35 of the pocket 25 will contact the ball.

To appreciate the advantage of locking a punch precisely positioned in the retainer block, the problem with using a pocket and retaining ball is illustratively presented in FIGS. 3 and 4 so it may be more readily visualized. Both problems, namely of securing the tool to the die shoe, and positioning the punch (and die bushing) precisely, is particularly severe with relatively small diameter punches having a shank less than about 7.6 cm (3 ins.) in diameter. A larger diameter shank may be secured and precisely positioned with screws and dowels through the shank and die shoe. In FIG. 3 is shown a shank 22A having a pocket 25A with an arcuate section having a radius substantially greater than that of ball 16A, allowing the punch to rotate slightly in either direction, as shown by the arcuate double-headed arrow, so that accurate alignment between a non-circular punch and its corresponding die bushing cannot be maintained. In FIG. 4, in shank 22B, the arcuate section of pocket 25B has a radius smaller than that of a ball 16B so that it engages the corner portions 34B, 35B of the pocket in the shank. Under operating conditions which generate high forces, depending upon the relative hardness of the ball and the shank, either one or the other, or both are distorted or damaged; at the very least the extreme edges 34, 35 of the pocket are pushed outward as shown at 38, 39.

Thus for optimum locking it is desirable to have the diameter of the ball accurately adapted to fit in the pocket so as to have the pocket contact the ball at two opposed points 33 inwardly spaced apart from the edges 34, 35 as shown in FIG. 2, the distance inward being chosen so as to avoid forcing the extreme edges 34, 35 outwards. Such precision is difficult to achieve in practice, and is proportionately so expensive as to be uneconomical. When achieved it will be evident that, the ball being a sphere, the contact at 33 is essentially point-contact with the surface of the pocket 25 and not substantially different from the point contact between the ball 16B and shank 22B with the pocket 25B.

To avoid using a ball lock mechanism, wedges have been used to lock a punch transversely in a retainer as illustrated in U.S. Pat. No. 3,137,193, the shank is provided with a flat (shank flat) on one side thereof which flat engages a cooperating flat formed on a tapered retaining pin fitting within a transversely extending opening formed in the punch retainer. Since the tapered pin cannot prevent the punch from moving vertically the shank must also be held by a pin the inner end of which has a sloping wedge surface which is adapted to engage a cooperating wedge surface formed on the shank of the punch as a part of a cutout on the opposite side from the shank flat. Even if one accorded this means for holding a punch in a retainer great merit for accuracy, it is evident that such a punch and retainer function to wedge the shank laterally, not vertically. The inclined surfaces form acute angles with the horizontal in a horizontal plane, that is, "laterally acute"; not with the vertical in the vertical plane, that is "vertically acute". Moreover such a mechanism is complicated and expensive to produce. Equally evident is why the ball lock punch retainer is the current standard for the machine tool industry.

In an analogous manner, when it is inconvenient or impractical to clamp a die bushing in a die-receiving hole, or one seeks either to avoid press-fitting a die bushing in the die-receiving hole, or using a ball lock mechanism to do so, the die bushing may be held as shown in U.S. Pat. No. 3,535,967 to Whistler et al. The die bushing is accurately positioned in a flexible retainer into which it is press-fitted and is held in the die retainer block by providing one side of the bushing with a flat surface, the flat cooperating with a corresponding flat on an aligning pin disposed transversely within a. transversely extending opening in the die retainer.

European Patent 0 446 536 A1 to Guy Pignon discloses several embodiments of an invention, including an upside-down perspective view of an assembly, illustrated in FIG. 19 of a pair of complementary wedges 1 and 2 forming a parallelpiped, and another assembly, in a normal operating position, illustrated in cross-sectional view in FIG. 20, of a single wedge 1, each of which assemblies secures a punch C held in a support plate (or retainer block) 6 which in turn, is secured to a support block (or die shoe) 7 through a backing plate 3. In each instance, the screw 5 enters the die shoe 7; in FIG. 20 the screw 5 is inserted through the die shoe 7 and threadedly secured in the wedge 1; in FIG. 19 the screw 5 is inserted through the retainer block 6 and threadedly secured in the die shoe 7 (shown in FIG. 2 of the Pignon reference).

In each embodiment of the Pignon assembly, the movable wedge 1 is directly, threadedly attached to the die shoe and provides a vertical tool-mating surface against which the tool (punch C) is clamped, and in each case, the orientation of the wedge is vertical, that is, in a substantially inverted V-shaped attitude in which the tool-mating surface is vertical and the opposed surface forms a vertically acute angle, downwardly directed away from vertical, the opposed wedge surface being in contact with the correspondingly inclined surface of the retainer block 6.

In this substantially inverted V-shaped attitude it is evident that the active wedging function is provided only during downward operation of the punch, by virtue of the angled wedge surface. By "active wedging function" is meant that there is positive mechanical interference, as if functioning as a detent, by virtue of the angled surface impeding movement in the direction in which the forming tool is moving, whether the forming tool is driven through the stock or withdrawn from it (stripped). In the '536 reference, when the punch has punched out the desired shape from the stock, and is then withdrawn, there is no active wedging function because the stripping forces are directed along the vertical tool-mating and shank surfaces (providing no active wedging function, only a clamping function); the inclined surface of the wedge which can now slide out because of the downward and outward inclination of the angle of the wedge surface. The same problem, namely providing only a clamping function and no active wedging function, arises with the complementary wedges in FIG. 19. Thus the wedging function provided by the Pignon assemblies is only useful in relatively light duty punching applications where the stripping force is low enough so as not to loosen the clamped punch during its retraction through the stock. This clamping function is more clearly evident in FIGS. 6 and 7 of the '536 reference.

During operation, because of the high forces generated during punching out steel and other metal stock, any wedge with a tool-mating surface becomes tightly held in the wedge cavity. To replace a punch, the wedge must be loosened in its cavity. To do this in the assembly shown in FIG. 20, access through the die shoe is necessary. The die shoe must be lowered out of the press, the screw 5 removed, and the wedge 1 driven downward with a dowel inserted through the bore of the screw. In FIG. 2 of the '536 reference, there is no access through the die shoe and how the wedge may be loosened is not described.

Note that, in each embodiment of the Pignon assembly, the screw which secures the wedge in the reatiner block 6, is either threaded into the die shoe 7 or is slidably inserted though it, to directly attach the wedge to the die shoe. In each instance, assembly requires removing the die shoe from the punch press and then refitting the die shoe in the press. Even in a relatively small 90-ton punch press, a typical die shoe which is about 61 cm×76 cm×5 cm (24"×30"×2") weighs about 200 Kg (440 lb) or more; removal requires use of a fork-lift truck or overhead crane. Moreover, every time the location of the wedges are changed, as when a different shape is to be punch out with a different punch, the die shoe must be machined for the new locations of threaded bores or through-passages, with attendant problems of new locations partially overlapping old, and in any all instances, limiting the useful life of a die shoe.

The problems of using a wedge which is attached to the upper die shoe and provides only a clamping function during stripping, and of having to remove and machine the die shoe from the press to install an assembly, are both overcome by the invention described herein. It accomplishes what the ball lock does, and much more, not only with respect to precision and strength, but also for economy and ease of operation; and permits quick replacement of the tool by releasing it in its tool-receiving cavity with a force which is proportional to the pitch of threads in the screw means which secures the wedge in its wedge cavity to the backing plate of the retainer block.

SUMMARY OF THE INVENTION

It has been discovered that a tapered holding means such as a wedge-shaped block ("wedge") locks a forming tool such as a punch or a die bushing and locates it accurately in a retainer block secured to a backing plate of a punch press without being directly attached to the upper die shoe; though the wedge is tightly locked in the retainer block during operation, the forming tool may be replaced without access through the upper die shoe or disassembling the retainer block; preferably, biasing means allows the wedge to lock the forming tool to provide an active wedging function.

It is therefore a general object of this invention to provide a tooling construction comprising in combination, a retainer block, forming tool such as a punch, die bushing, and a wedge means directly attached to the backing plate but not directly attached to the die shoe of a punch press; the retainer block has a tool-and-wedge-receiving cavity or passage therein adapted to receive both the punch or die bushing and the wedge means which, in operation, are locked in position relative to each other; the wedge means is provided with at least one inclined surface inclined from the vertical, and a tool-contacting, preferably tool-mating surface; and, biasing means to releasably secure the wedge within the retainer block so as to lock and unlock the punch in the tool cavity.

It is a specific object of this invention to provide a substantially inverted V-shaped wedge directly attached to the backing plate but not directly attached to the upper die shoe, and releasably movably secured in a wedge cavity in a retainer block, the wedge having one vertical tool-mating surface and an opposed surface in contact with a retainer block, the opposed surface forming a vertically acute angle surface directed downward and away from the vertical (see FIGS. 6 & 7).

It is another specific object of this invention to provide a substantially V-shaped wedge directly attached to the backing plate but not directly attached to the upper die shoe, and releasably movably secured in a wedge cavity in a retainer block, the wedge having one vertical surface and an opposed surface forming a vertically acute angle (measured from the vertical), the inclined surface providing a detent function by interfering with removal of the punch by stripping forces (see FIGS. 8, 9, 10).

It is another specific object of this invention to provide a substantially V-shaped wedge directly attached to the backing plate but not directly attached to the upper die shoe, and releasably movably secured in a wedge cavity in a retainer block, the wedge having opposed oppositely inclined surfaces diverging from the vertical, forming vertically acute angles measure from the upper vertical line (see FIGS. 15, 15A, 17 & 18).

It is another specific object of this invention to provide a generally inverted V-shaped wedge directly attached to the backing plate but not directly attached to the upper die shoe, and releasably movably secured in a wedge cavity in a retainer block, the wedge having opposed surfaces each forming a downwardly vertical acute angle (measured on each side of the vertical in the lower quadrants); the angles may be oppositely directed to provide diverging wedge surfaces (see FIG. 11), or similarly directed to provide non-diverging wedging surfaces (see FIGS. 15C, 15D, 17A, 18A).

It is also a general object of this invention to provide a method for securing a punch or forming punch or die bushing ("tool") in a retainer block, comprising, forming therein a tool-and-wedge-receiving cavity shaped to provide both a tool cavity and a wedge cavity into each of which is closely received the tool and the wedge respectively; forming a wedge means adapted to be inserted in the wedge cavity, the wedge having an inclined surface ("wedge-inclined surface"); shaping the wedge to provide both a tool-mating surface and the wedge-inclined surface for contact with the retainer block, each surface preferably oppositely disposed relative to the other; assembling the wedge and the retainer block so as to form a tool cavity without directly attaching the wedge to the upper die shoe of the punch press; inserting the tool within the cavity so as to be closely received therein and slidable relative to the tool-mating surface; and, providing relative movement between the tool-mating surface and the tool, sufficient to releasably lock the tool in the cavity.

It is a specific object to provide corresponding inclined surfaces on the following cooperating surfaces: (i) the wedge-inclined surface and a wall of the cavity in contact with the wedge inclined surface (see FIGS. 6–9, 15); (ii) the tool surface and the wedge's tool-mating surface (see FIG. 10); or (iii), both (i) and (ii) (see FIGS. 11, 17 & 18).

It is a specific object of this invention to provide a method for securing and releasing a punch or forming tool in a retainer block, comprising, forming a wedge-shaped cavity in the block wherein at least one surface of the block ("inclined block surface") is inclined from the vertical; forming a single wedge having at least one inclined surface ("wedge inclined surface") adapted to slidably cooperate with a correspondingly inclined surface on either the block or the punch, or both, the wedge being shaped to provide a tool-mating surface and a wedging surface, one oppositely disposed and inclined relative to the other, when the wedge is inserted into the wedge cavity, the tool-mating surface in cooperation with surfaces of the wedge cavity providing a tool passage within which the tool is to be held; inserting the wedge into the cavity; inserting the tool into the tool passage; and releasably securing the wedge within the retainer block to permit vertical movement thereof relative to the retainer block without directly attaching the sedge to the upper die shoe of the press.

It is another general object of this invention to provide a method for making a retainer block and a tool adapted to be held in a cavity therein, comprising positioning a block of material in a wire electric discharge machine ("EDM"); programming the machine to cut a tool of desired shaped from within the block with a wire so as to form a tool cavity having an arbitrary cross-section and being open at both the top and bottom of the block; and, programming the machine to cut a wedge of desired shape from within the retainer block with the wire, the wedge having at least one inclined surface inclined from the vertical at an angle from about 0.25° to about 30°, so as to form a wedge cavity; whereby the wedge is releasably insertable in the wedge cavity and the tool, however formed, is releasably insertable in the tool cavity.

It is a specific object of this invention to cut, using wire EDM, not only the wedge, but also the tool-and-wedge cavity from the retainer block using a thin wire having a sufficiently small diameter to provide the desired clearances between tool, wedge and cavity.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 1:
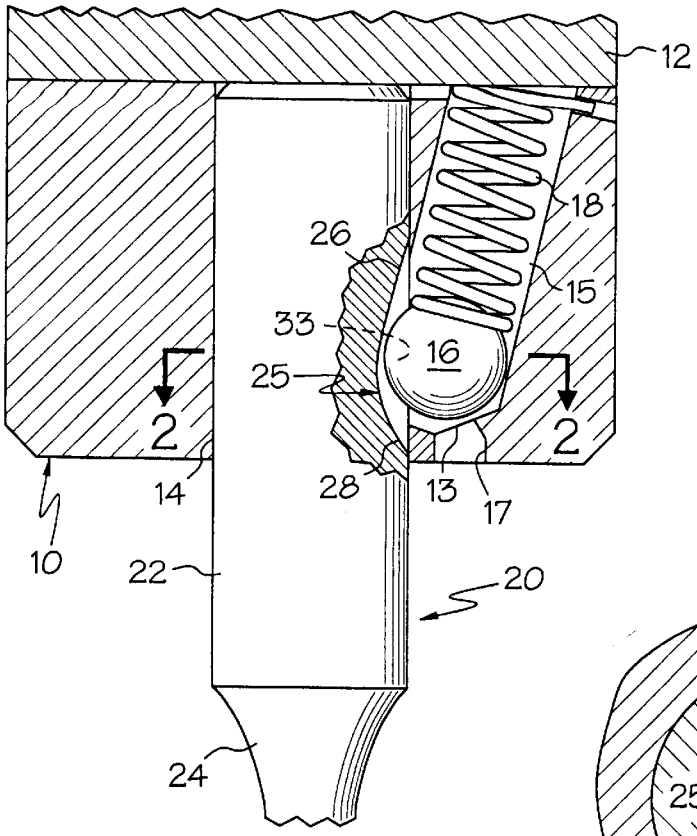
FIG. 1 PRIOR ART
FIG. 1 is central vertical, sectional view of a conventional retainer block provided with a retaining ball releasably holding a punch.
Figure 2:
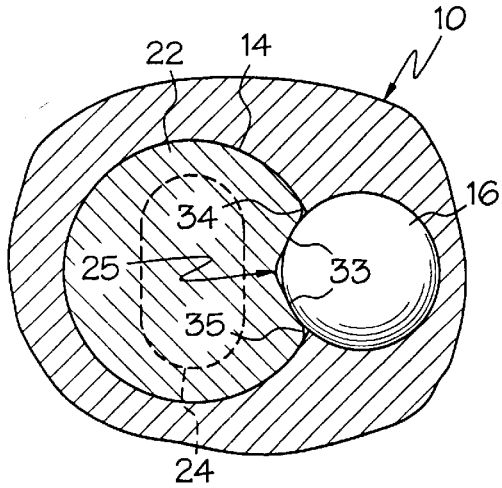
FIG. 2 PRIOR ART
FIG. 2 is a cross-section taken along the line 2—2 of FIG. 1, looking in the direction of the arrows.
Figure 3:
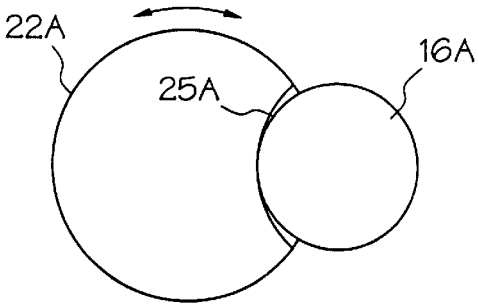
FIG. 3 PRIOR ART
FIG. 3 is a diagrammatic sectional view, in the lateral plane, of a ball having a diameter slightly greater than that of the pocket.
Figure 4:
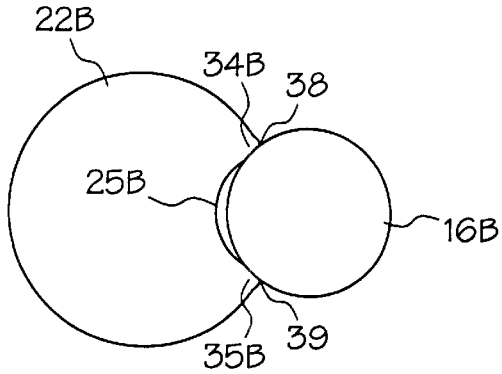
FIG. 4 PRIOR ART
FIG. 4 is a diagrammatic sectional view, in the lateral plane, of a ball having a diameter slightly smaller than that of the pocket.
Figure 5:
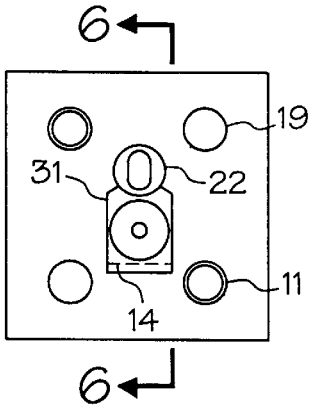
FIG. 5 is a bottom plan view, looking up, at a punch having a cylindrical shank and an oval point, the shank being held in a retainer block with a wedge.
Figure 6:
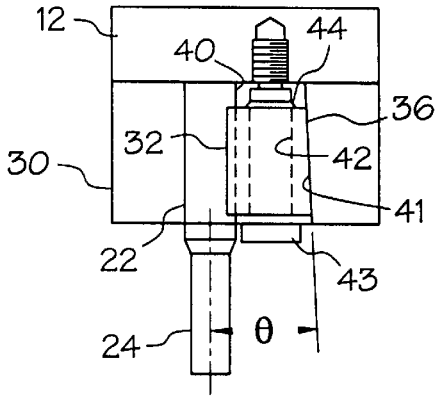
FIG. 6 is a side elevational view taken along the line 6—6 of FIG. 5, looking in the direction of the arrows, showing a wedge having an inclined wedge surface at an angle θ (theta) which is inclined relative to the vertical center line through the punch, showing a first embodiment for releasably securing the punch.

Referring to FIGS. 5 and 6 there is illustrated a punch 20 having a cylindrical shank 22, without a ball-receiving pocket, and a point 24 with a substantially oval cross-section. The shank 22 is held in retainer block 30 with wedge 31. Wedge 31, in lateral cross-section, has a generally polygonal periphery except for one side 32 which is arcuate, representing the wedge's arcuate, essentially vertical tool-mating surface which is adapted to closely receive the shank 22. If the shank 22 were rectangular in cross-section, the side 32 would represent a vertical planar surface and the periphery would be linear. The peripheral outline of the mating surfaces is not critical so long as they are in contact to enable the tool to be secured in the retainer block.

The wedge 31 has an inclined surface 36 which is on the opposite side from the surface 32, and is accurately machined relative to the other surfaces of the cavity; the upper edge of the wedge 31 is represented in phantom outline by the dashed line 14. The surface 36 is inclined at a vertically acute angle θ relative to the vertical center line through the punch. The term "acute" refers to the included angle (as shown) formed by the intersection of the wedge surface and the vertical plane, as viewed frontally in the quadrant identified. Since the arms of this angle open and diverge downwards, the wedging surface is referred to as having a "downwardly acute angle" measured in the lower right quadrant from the lower vertical line, as shown, and the wedge 31 as being substantially "inverted V-shaped". It will be evident that the angle θ is not narrowly critical as long as it is less than 90° and greater than 0° (relative to the vertical plane), but it will be evident that a much smaller angle, less than 60° will provide an adequate wedging function. Preferably the angle is in the range from about 1° to 45°, the larger angles generally facilitating release of the wedge for any reason, for example, when the punch is to be changed. For most punch retainer combinations the most preferred acute angle is in the range from about 1° to about 20°.

The wedge 31 is received in the retainer block 30 which is provided with a vertically extending through-passage also referred to as a tool-and-wedge receiving cavity 40 sized to closely receive the upper portion or shank 22 and also the wedge 31 having a tool-mating surface 32. As shown in FIG. 6, one wall 41 of the cavity is inclined at the same acute angle as the wedge surface 36 so that the wedge 31 may be moved against and along the wall 41 of the block. Wedge 31 is provided with a through-bore 42 into which a fastening means such as an Allen head shoulder screw 43 is inserted, and a snap ring 44 is disposed within a circumferentially extending groove cut above the threads. The function of the snap-ring is to retain the wedge in operative relationship with the retaining block and tool, and provide a positive stop against which the wedge's upper surface is biased when the screw 43 is loosened in the backing plate 12 into which the screw 43 is threaded. The shank 22 is inserted in the passage between the face 32 and the opposed face of the tool cavity 40. The wedge is so dimensioned that tightening the Allen screw 43 tightly secures the shank in the retainer block. To remove the punch, the Allen screw 43 is loosened and the snap ring 44 will bias the wedge block away from the backing plate 12 sufficiently to free the punch. Without such positive biasing means to urge the wedge downwards, it would be tightly held by the great force exerted during operation of the punch, and could only be removed by disassembling the retainer block 30 from the backing plate 12, then driving the wedge out.

Since the purpose of the wedge-inclined surface is to provide an active wedging force it is not necessary that the tool-mating surface be opposite the wedge-inclined surface, though it is preferred that it be. As will be evident in the embodiments shown in FIGS. 7 and 8 below, neither the die shoe nor the backing plate need be threaded. Of course, in practice, one routinely uses a backing plate for convenience of removal and replacement, and because a die shoe is not adequately hardened.

The backing plate or punch retainer pad 12 is held in operative position against the upper die shoe of a press by retaining means such as Allen head retaining screws 11 which are inserted in through-bores in the block 10 and threadedly secured in the backing plate 12; dowel pins 19 align the backing plate accurately. It will be appreciated that a through-hardened backing plate is typically provided to save the die shoe (not shown) which is typically not hardened and would be damaged if the retainer pad 12 was omitted.

Figure 7:
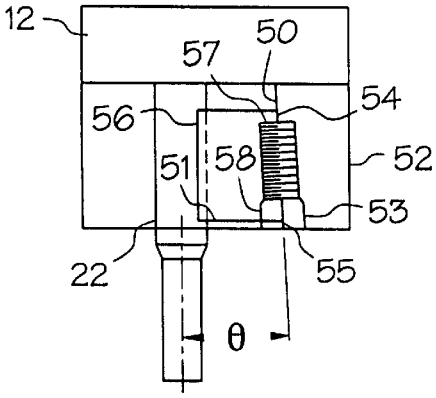
FIG. 7 is a side elevational view, analogous to that in FIG. 6 showing a wedge having an inclined wedge surface at an angle 0, but showing a second, alternative embodiment for releasably securing the punch.

Referring to FIG. 7 there is shown another embodiment in which a wedge 51 is translated within the tool-and-wedge cavity 50 of a retainer block 52 with a screw, such as an Allen bead set screw 53. One wall 54 of the cavity 50 is inclined at a downwardly acute angle θ, as is one face 55 of the wedge which cooperates with the wall 54 to provide the desired wedging force. The upper portion of the wall 54 has a channel-shaped groove cut in it, the length of the channel corresponding to the length of the threads on the set screw 53. The upper end of the screw 53 abuts the top of the channel at 57 and the head of the set screw abuts the lower surface of the wedge at 58. The inclined wall 54 of the cavity 50 is threaded to threadedly receive the set screw 53, so that as the set screw is rotated in one direction, the wedge is translated upward towards the backing plate 12, and when the direction of rotation of the screw 53 is reversed, the wedge moves downward. The extent to which the threads (that is, length measured along the inclined wall) are cut in the wall 54 corresponds to the distance the wedge is to travel. As before, tool-mating face 56 of wedge 51 is vertical and arcuate to closely receive the cylindrical shank 22 of the punch 20. As before the backing plate is secured to the die shoe and in the description of the following additional embodiments for utilizing the wedge, securing the backing plate to the die shoe will not be repeated.

Figure 8:
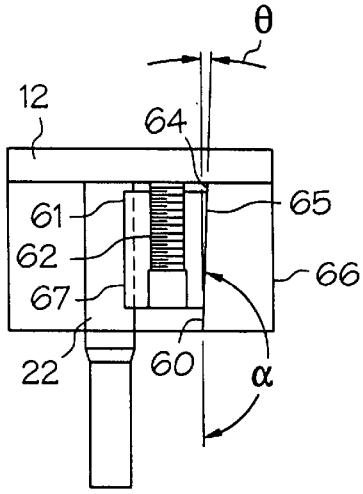
FIG. 8 is a side elevational view, analogous to that in FIGS. 6 and 7, but showing a third, alternative embodiment for releasably securing the punch held by a wedge having a wedge surface at an obtuse angle α (alpha) relative to the vertical center line through the punch.

Referring to FIG. 8, tool-and-wedge cavity 60 is provided in a retainer block 66 with an inclined wall 64, and wedge 61 has an inclined surface 65 which cooperates with the wall 64, each inclined at an obtuse angle $\alpha$ relative to acute angle $\theta$. The term "obtuse" refers to the angle (as shown) formed by the intersection of the wedge surface and the vertical plane, as viewed frontally and measured upward starting at the vertical in the lower right quadrant. This is consistent with the use of the term "acute". It will be evident that obtuse angle $\alpha$ is the complementary angle of acute angle $\theta$, but oppositely directed as if in mirror image relationship, the mirror positioned in a plane vertical with respect to the paper. For convenience, and to visually convey this relationship, the obtuse angle $\alpha$ of the wedge inclined surface is hereafter referred to as an "upwardly acute angle $\theta$" measured in the upper right quadrant from the upper vertical line, as shown, and the wedge 61 as being substantially "V-shaped". As before, this upwardly acute angle is not narrowly critical as long as it is less than 180° and greater than 90° relative to the vertical plane, but it will be evident that an angle greater than 120° will provide an adequate wedging function. Preferably the angle is in the range from about 135° to 179°, the numerically smaller angles generally facilitating release of the wedge. For most punch retainer combinations the most preferred obtuse angle is in the range from about 160° to about 179°.

An upwardly inclined wedge is particularly suited for use with a punch stripper subjected to higher forces than tolerated by a ball lock mechanism. Wedge 61 is provided with a bore 62 which is partially threaded so that rotation of an Allen screw 63 threaded in the bore, when the end of the screw is biased against the backing plate 12, translates the wedge up and down. As before, shank 22 is closely received in tool-mating surface 67. When the screw is rotated so the wedge is translated downwards the wedge locks the shank 22 in position; when translated upwards, the shank is released.

Because the wedge 61 has an upwardly inclined face, the combination of retainer block and wedge is assembled prior to securing it to the die shoe unless the angle $\theta$ is small enough relative to the thickness of the retainer block 66 that, when the wedge 61 is in its uppermost position near the lower surface of the backing plate 12, there is sufficient clearance for the shank to be inserted in the tool-and-wedge cavity 60. The screw 63 is threaded in the wedge 61 so that the end of the screw is flush with the surface of the wedge, and this assembly is secured on the backing plate 12. With a typical angle of 3° on the wedge 61, the retainer block 66 is fitted over the wedge so that the cooperating inclined surfaces are in contact and the wedge is captured. The retainer block 66 is then secured to the backing plate 12. This procedure is followed in all instances where one of the surfaces of the wedge is upwardly inclined with an angle too large to allow the shank to be inserted from beneath with the wedge in the tool-and-wedge cavity. The advantage of capturing the wedge in the retainer block before it is secured to the die shoe is that the wedge is not misplaced.

Figure 9:
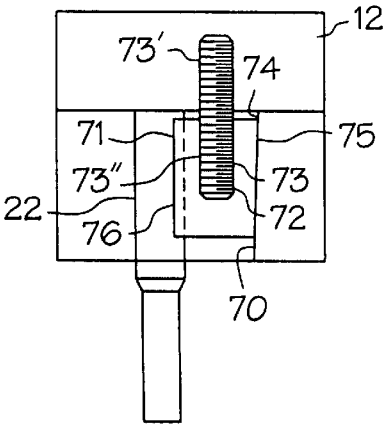
FIG. 9 is a side elevational view, analogous to that in FIG. 8, showing a wedge having a wedge surface at an obtuse angle α, but showing a fourth, alternative embodiment for releasably securing the punch.

Referring to FIG. 9, retainer block 75 is provided with tool-and-wedge cavity 70 having an inclined wall 74, and wedge 71 has an inclined surface 77 which cooperates with the wall 74, each inclined at an upwardly acute angle $\theta$ so as to form a substantially V-shaped wedge. Wedge 71 is provided with a threaded bore 72 in which a screw 73 is threaded. One portion 73' of the screw 73 is threaded with a left hand thread, and the remaining portion 73" is threaded with a right hand thread. Accordingly, the threaded bore in wedge 71 is of opposite "hand" relative to a threaded bore in backing plate 12, and the screw operates in a manner analogous to a turnbuckle. As before, the wedge is captured in the retainer block 75 before it is secured to the die shoe and shank 22 is closely received in tool-mating surface 76. When the screw is rotated so the wedge is translated downwards the wedge locks the shank 22 in position; when translated upwards, the shank is released.

Figure 10:
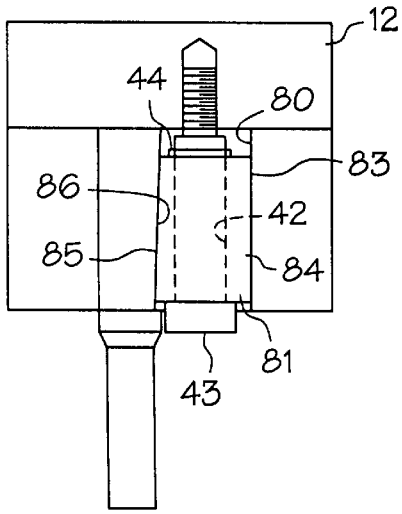
FIG. 10 is a side elevational view, analogous to that in FIG. 6, but showing a fifth, alternative embodiment for releasably securing the punch held by a wedge in which its tool-mating surface is at an acute angle θ (theta) relative to the vertical center line through the punch, and the opposite surface of the wedge in contact with the wall of the cavity in the retainer block, is vertical.

Referring to FIG. 10, retainer block 85 is provided with tool-and wedge cavity 80 having a vertical wall 84, and wedge 81 has a vertical surface 83 which cooperates with the wall 84. The tool-mating face 85 of the wedge is inclined at an downwardly acute angle $\theta$ and is adapted to closely receive the correspondingly obtusely inclined surface 86 of shank 22 to form a generally inverted V-shaped wedge. Since the shank is cylindrical, the inclined surface 86 is arcuate. Wedge 81 is provided with a through-bore 42 into which an Allen screw 43 is inserted and a snap-ring 44 is placed in a groove cut above the threads. As before, shank 22 is closely received in tool-mating surface 85; and, the wedge 81 is dimensioned so that tightening the Allen screw 43 secures the shank in the retainer block; loosening the screw allows the snap-ring to help move the wedge and release the punch.

Figure 11:
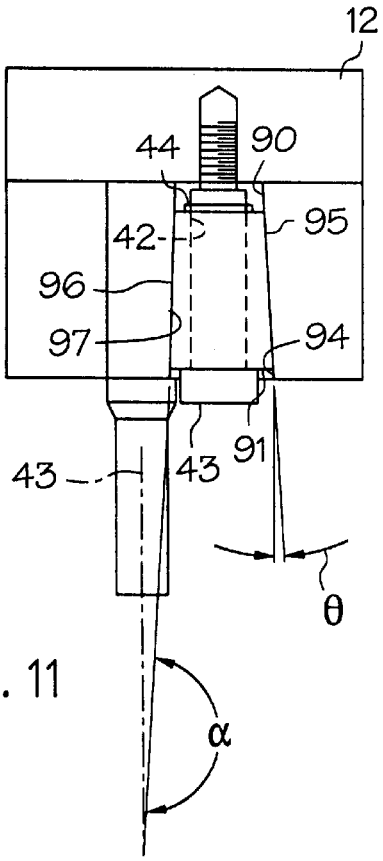
FIG. 11 is a side elevational view, showing a sixth, alternative embodiment for releasably securing the punch, in which embodiment wedge surfaces on opposed sides are oppositely inclined, in a generally inverted V-shaped configuration, one at an obtuse angle α, the other at an inclined angle θ.

Referring to FIG. 11, retainer block 95 is provided with tool-and-wedge cavity 90 having an inclined wall 94, and wedge 91 which has an inclined surface 95 cooperating with wall 94, each inclined at a downwardly acute angle $\theta$. The opposed tool-mating face 96 of the wedge is inclined at an upwardly acute angle $\theta$ and is adapted to closely receive the correspondingly obtusely inclined surface 97 of shank 22. To distinguish this wedge 91 as positioned herein, from a V-shaped wedge, wedge 91 is stated to have a first wedging surface inclined at an upwardly acute angle, and a second wedging surface inclined at a downwardly acute angle to form an inverted V-shaped wedge. Since the shank is cylindrical, the inclined surface 96 is arcuate. Wedge 91 is provided with a through-bore 42 into which an Allen screw 43 is inserted and a snap-ring 44 is placed in a groove cut above the threads. As before, shank 22 is closely received in tool-mating surface 96; and, the wedge 91 is dimensioned so that tightening the Allen screw 43 secures the shank in the retainer block; loosening the screw 43 in the backing plate 12 allows the snap-ring to help move the wedge and release the punch.

In each of the foregoing descriptions of embodiments of the invention, the shank is shown as being cylindrical, as is conventional, and for the common instance where a the point punches a circular hole in a web of stock, the rotation of the shank in its cavity is immaterial if its clearances relative to the die bushing are correctly established. However, in cases where the dimensional tolerances of the cooperating surfaces of the punch, the retainer block and the die bushing are critical and must be tightly controlled, the punched hole is required to be within tolerances less than 25.4 $\mu$m (microns or micrometers) or 0.001" (inch). For example, where the point is non-circular in cross-section and the shank is cylindrical, and the point is to be accurately positioned with a clearance of 12.7 $\mu$m or (0.0005") in a correspondingly shaped die bushing, the cylindrical shank is provided with a flat, and a corresponding mating flat is provided in the wedge's tool-mating surface. When the cross-section of a non-circular punch is the same in its upper and lower portions, the punch cavity in the retainer block is correspondingly shaped with a minimum clearance, typically 12.7

μm. Whether the cross-section of the shank is circular or not, the force with which the wedge secures the punch in the retainer block is much greater than that exerted by a conventional ball lock and spring in the same application with the same size punches. For example, a 9.84 mm (0.25") ball in the pocket of a punch with a 9.5 mm. (0.375") diam shank and a conventional ball lock and spring, is shattered when a stripping force of 272.7 Kg (600 lbs) is exerted on the punch; the same shank is held with a stripping force of 909 Kg (2000 lbs) when it is secured with a downwardly inclined wedge (FIG. 6), when slipping of the punch occurred. No such slipping would occur with both an upwardly inclined tool-mating surface and a downwardly inclined wedge-inclined surface (FIG. 11).

It will also be noted that in embodiments shown in FIGS. 5, 6, 9, 10, 11, 12 and 14 the wedge is held in the tool-and-wedge cavity by a screw which is threaded into the backing plate, but a screw is not so threaded in the embodiments shown in FIGS. 7 and 8, though the screw does cooperate with the backing plate to move the wedge in all embodiments except that in FIG. 7.

Figure 12:
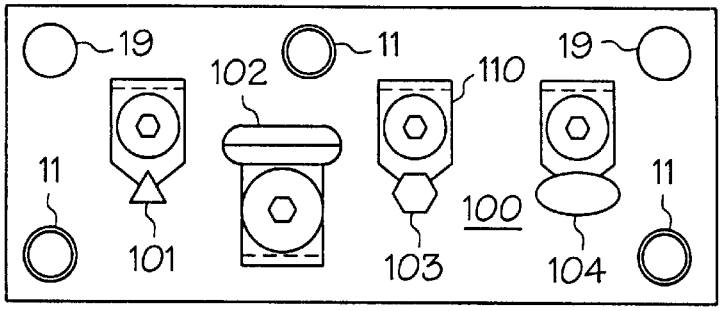
FIG. 12 is a bottom plan view, looking up, at plural punches in a punch assembly having a common retainer block and backing plate, in which assembly each non-circular shank is held non-rotatably against the wedge's shank-mating surface; the shank is integral with, and has the same cross-section as its point, and the cross-section is of arbitrary non-circular shape.

Referring to FIG. 12 there is schematically illustrated a bottom plan view, looking up, of a retainer block 100 in which multiple punches 101, 102, 103, and 104 are commonly held and positioned with dowel pins 19, then secured against a backing plate with Allen screws 11. Each punch is a rod of appropriately hardened steel or other metal, the rod having a uniform cross-section, but each rod has a cross-section of different shape. Each rod is secured with a wedge having a correspondingly shaped tool-mating surface to receive a portion of the periphery of the punch. The remaining portion of the periphery is received by a correspondingly shaped tool-mating surface in the wall of the retainer, opposite the wedge. In each of the above wedges, the tool-mating surface is vertical and the opposed inclined surface is at a downwardly acute angle θ. In each case the wedge is vertically translatable in its respective tool cavity to an extent sufficient to release the tool, whether punch, forming tool or die bushing.

Figure 13:
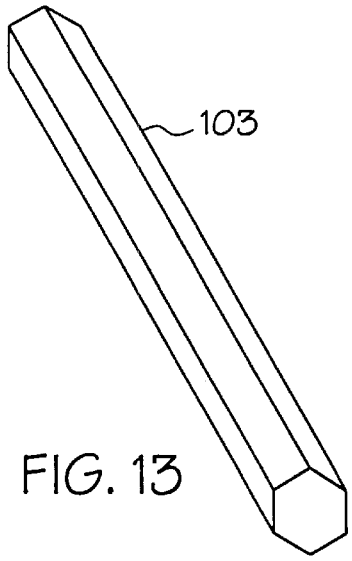
FIG. 13 is a perspective view of a hexagonal punch illustrating a shank and point with a common cross-section.

FIG. 13 is a perspective view of punch 103 which is of substantially hexagonal cross-section, as shown in the combination of wedge and punch identified by reference numeral 103 in FIG. 12. Approximately one-third of the periphery of the punch is received in a one-third-hexagon-shaped tool-mating surface of retainer block 110, and the remaining two-third is received in a vertical surface of corresponding two-third-hexagon shape which is cut in the retainer block.

Figure 14:
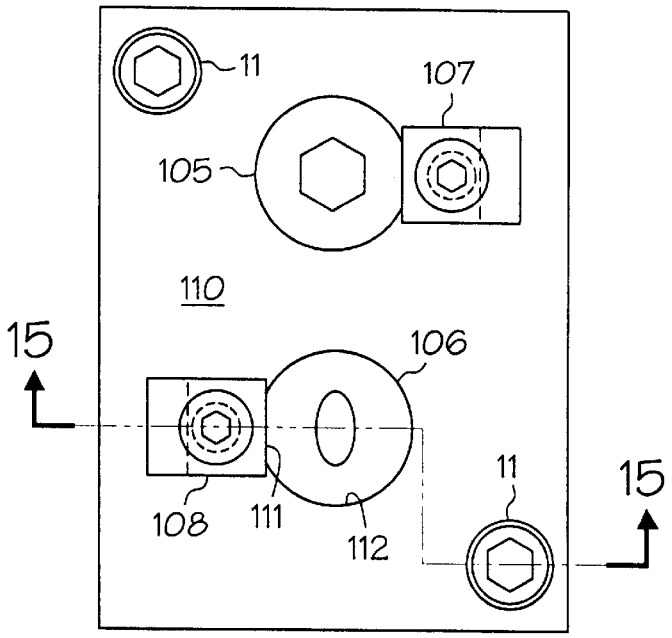
FIG. 14 is a top plan view, looking down, at a pair of die bushings in a die bushing assembly for a pair of punches having oval and hexagonal cross-sections respectively, the assembly having a common retainer block.

Referring to FIG. 14 there is illustrated a pair of die bushings 105 and 106 secured by wedges 107 and 108 respectively in a common die bushing retainer block 110 which, in turn, is secured to the lower die shoe of a punch press with Allen screws 11. Each die bushing is non-circular and has a planar upper surface defining a point-receiving through-passage therein to receive a correspondingly non-circular punch accurately positioned relative to the common die retainer block and the corresponding punches. In each case, the wedge inclined surface is accurately machined relative to the non-circular point. The goal is to provide a highly secure and accurate position of the die bushing without having any structural component protruding substantially above the surface of the retainer block 110, that is, does not interfere with accurately positioning stock on the die retainer block.

Figure 15:
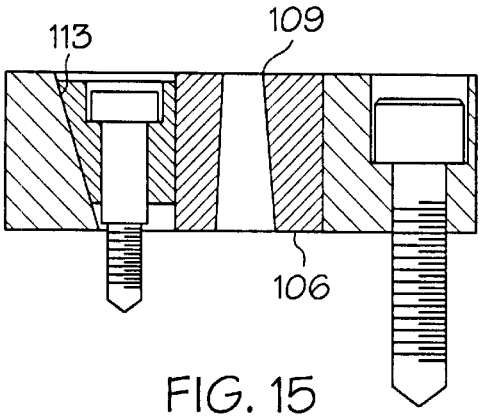
FIG. 15 is a side elevational view taken along the line 15—15 of FIG. 14, looking in the direction of the arrows, showing a cylindrical die bushing held by a wedge secured to a lower backing plate of a lower die shoe, the wedge having a wedge surface inclined at an angle θ (theta) relative to the vertical center line through the punch.

Referring to FIG. 15 there is shown a die bushing 106 having an elliptical tapered through-bore 109 which at the surface of the retainer block provides the precise desired clearance of the elliptical punch it is to receive. One portion of the die bushing 106 is provided with a flat 111 which is held by a corresponding flat surface on wedge 108. The tool-and-wedge cavity 112 is outlined by the periphery of the die bushing 106 and the wedge 108, the wall 113 of the cavity being inclined at an acute angle θ to the vertical, this being the included angle between the plane of the inclined surface and the vertical plane through the center of the Allen screw 43, viewed frontally in the upper left hand quadrant. The tool-mating surface of the wedge being planar and vertical, as before, an Allen screw 43 threaded into the lower backing plate 12' secures the die bushing in position when the screw is tightened. The backing plate 12' is provided with a through-bore 171 to discharge the blank punched out. A snap-ring 44 in a groove above the threads allows release of the die bushing when the screw is loosened. In lieu of a snap ring, a spring washer may be interposed between the lower surface of the wedge and the surface of the backing plate.

Figure 15A:
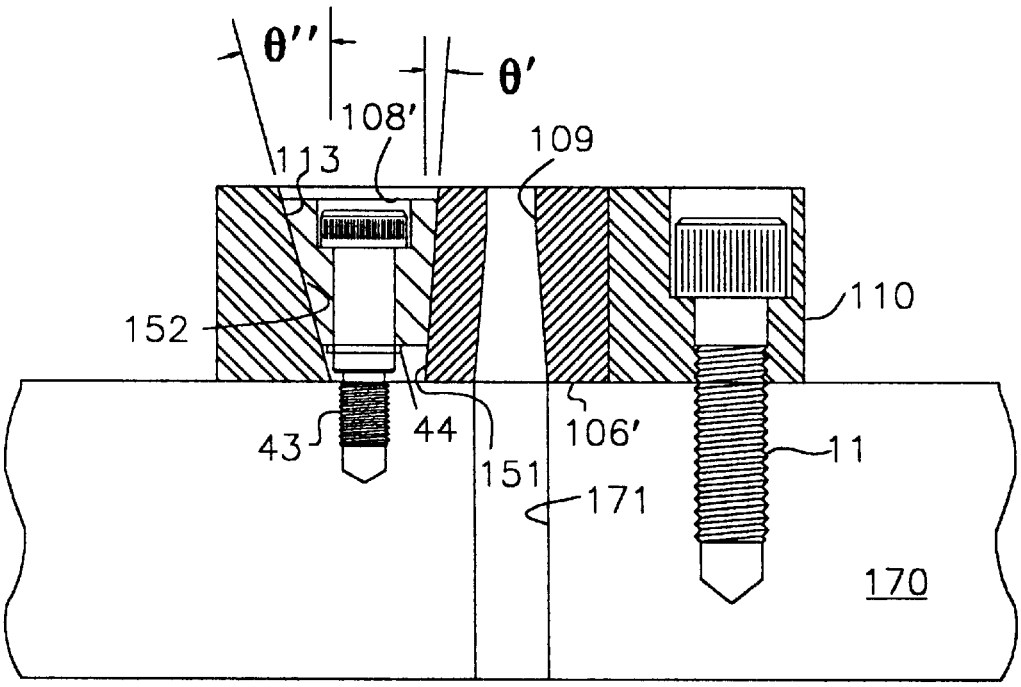
FIG. 15A is a side elevational cross-sectional view analogous to that shown in FIG. 15, of an embodiment of a V-shaped wedge securing a wedge-shaped die bushing. The wedge has opposed wedge surfaces each inclined at angles θ' (theta) and θ" measured from either side of the upper vertical, to provide active wedging in both up and down directions; the wedge is secured directly to the lower die shoe.

Referring to FIG. 15A there is shown a wedge 108 directly attached to the lower die shoe 170 of a press. The die bushing 106' has an elliptical tapered through-bore 19 which at the surface of the retainer block 110 provides the precise desired clearance of the elliptical punch it is to receive. One portion of the die bushing 106 is provided with an inclined surface 111 which is held by a corresponding inclined surface on wedge 108. The tool-and-wedge cavity 112 is outlined by the periphery of the die bushing 106' and the wedge 108', the wall 113 of the cavity being inclined at an acute angle θ" measured in the second quadrant from the upper vertical line. The wedge 108' has upwardly diverging opposed surfaces; a first wedging surface 151 is inclined at an upwardly and outwardly acute angle θ', measured in the first quadrant from the upper vertical line; and, an oppositely inclined second wedging surface 152 is inclined upwardly and outwardly at an acute angle θ", measured in the second quadrant from the upper vertical line, as shown, to form a V-shaped wedge with diverging surfaces. An Allen screw 43 threaded into the lower die shoe 170 (shown) with a snap-ring 44 placed in a groove cut above the threads, secures the wedge 108' and die bushing 106' in position when the screw is tightened, and releases the die bushing when the screw is loosened.

Figure 15B:
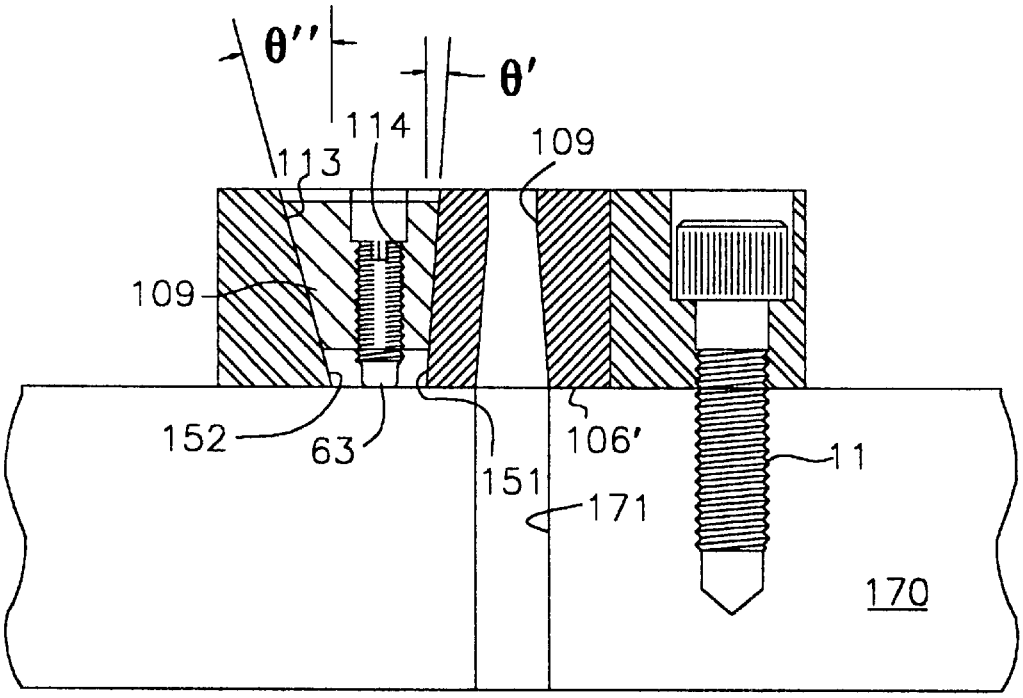
FIG. 15B is a side elevational view, analogous to that shown in FIG. 15A, of an embodiment in which machining the lower die shoe is avoided.

When a backing plate is not provided on the lower die shoe 170, it is highly desirable to avoid machining the lower die shoe, and this is accomplished by using a wedge 108' provided with a bore 114 which is threaded as shown in FIG. 15B. The wedge 108' is tapped down to lock the die bushing 106' which becomes tightly locked during operation. Rotation of an Allen screw 63 threaded in the threaded bore, biases the end of the screw against the die shoe 170, and moves the wedge 108 up, to release the die bushing 106.

Figure 15C:
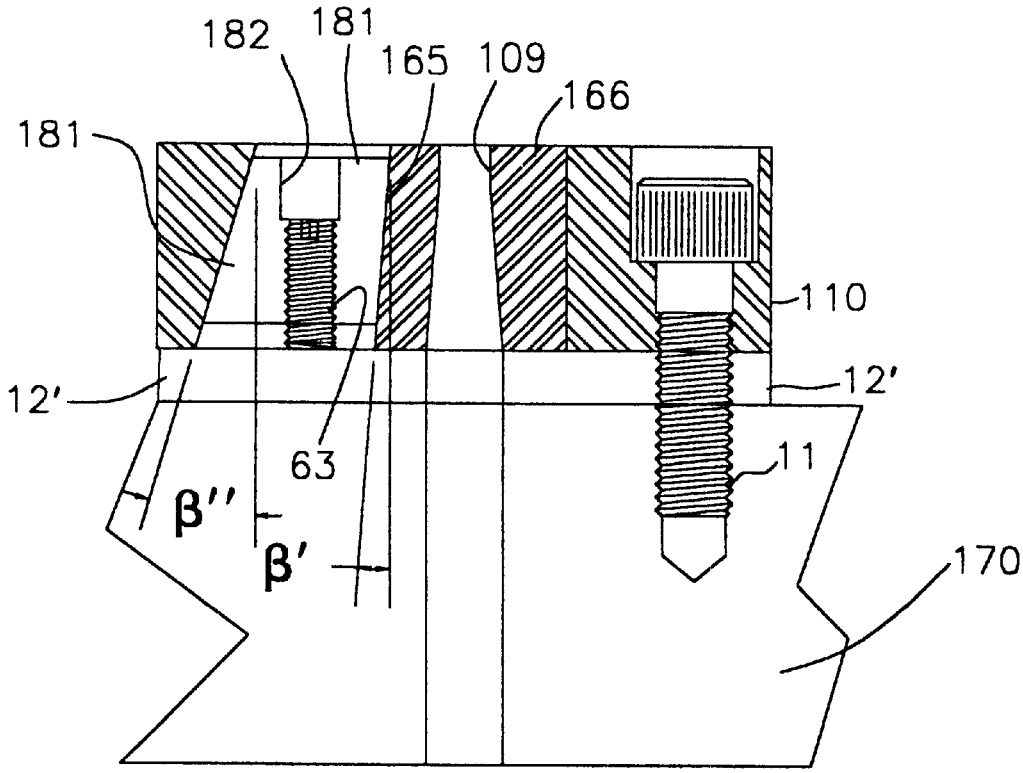
FIG. 15C is a side elevational cross-sectional view analogous to that shown in FIG. 15A, of an embodiment of a inverted V-shaped wedge which has opposed wedge surfaces each inclined at acute angles β' (beta) and β", measured in the third quadrant from the lower vertical, to provide active wedging in both up and down directions; the wedge is biased against the lower backing plate of the lower die shoe.

Referring to FIG. 15C, retainer block 110 is secured through a lower backing plate 12' to a lower die shoe 170. A die bushing 166 having bore 109 is provided with a vertical surface and an opposed first surface 165 inclined at acute angle β', measured in the third quadrant from the lower vertical line is held in the retainer block 110. The die bushing 166 is secured in position by wedge 181 having a central stepped bore 182, the lower portion of which is threaded to accept Allen screw 63 which protrudes from the lower surface of the wedge. The wedge has a first wedging surface 168 in slidable contact with surface 165 and also inclined at acute angle β'; and an opposed second wedge surface inclined at acute angle β", similarly measured, to form an inverted V-shaped wedge with non-diverging surfaces.

Figure 15D:
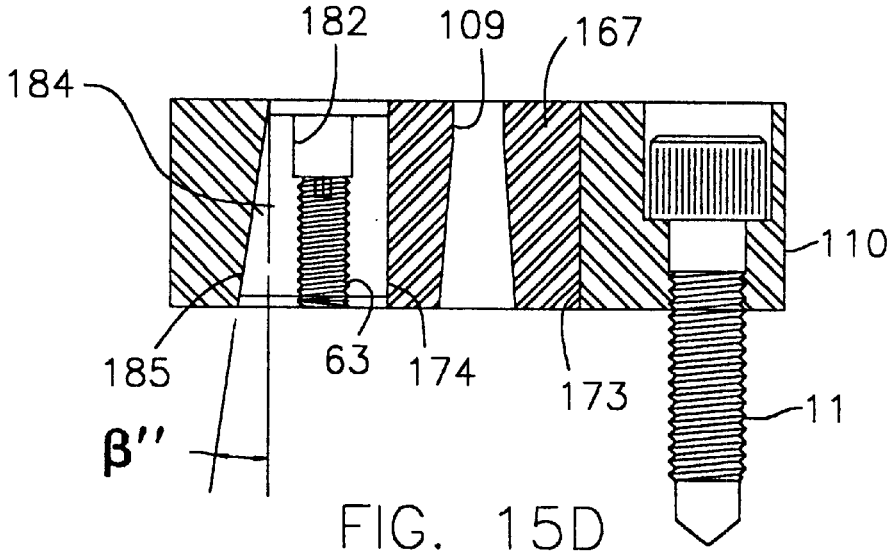
FIG. 15D is a side elevational cross-sectional view analogous to that shown in FIG. 15C, of an embodiment of a inverted V-shaped wedge which has a vertical surface and a single opposed wedge surface inclined at an acute angle β" measured in the third quadrant from the lower vertical, to provide active wedging in both up and down directions; there is no lower backing plate and the wedge is biased against the lower die shoe.

Referring to FIG. 15D, retainer block is secured through a lower backing plate to a lower die shoe (not shown) as in FIG. 15C. A die bushing 167 having bore 109 is provided with a opposed first and second vertical surfaces 173 and 174. Wedge 184 having partially threaded stepped bore 182 with Allen screw 63 has a vertical first surface in cooperation with surface 174 and an opposed second surface 185 inclined at acute angle β", measured in the third quadrant from the lower vertical line, to form an inverted V-shaped wedge with a single diverging surface.

Though the cross-section of the wedges illustrated in the FIGS. 5, 12 & 14 indicate they have been cut from a rectangular block, as would be the wedges cut in FIGS. 8, 9, 10 and 11, it will be evident, that the wedge could be cut so as to have an arbitrary cross-section (in the lateral plane shown) so long as the tool-mating surface corresponds to the surface of the tool, and the wedge inclined surface corresponds to the inclined surface in the retainer block.

Figure 16:
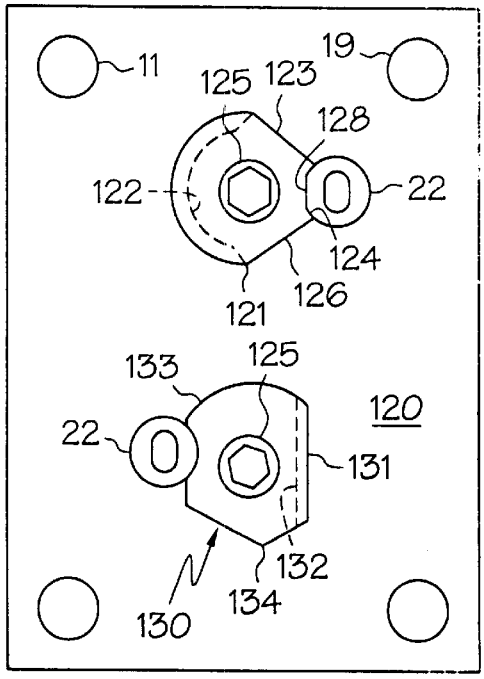
FIG. 16 is a bottom plan view, looking up, at a pair of identical punches in a common retainer block, one punch secured in a retainer block by a partially frustoconical wedge with an arcuate vertical tool-mating surface, the other punch secured by a wedge with a planar inclined wedge surface, two arcuate vertical surfaces, one being a tool-mating surface, and three vertical planar surfaces.

Referring to FIG. 16 there is shown a the shank 22 of a punch held in a tool cavity formed within common retainer block 120 by a partially frustoconical wedge 121 received closely between an inclined surface of a partial cone cut in the retainer block, the surface being scribed and cut at a downwardly inclined angle θ. The conical surface of the partial cone cut in the block corresponds to the conical surface of the conical wedge, the upper outline of which is shown by the dotted line 122. The surfaces 123 and 126 of the wedge are vertical and planar. The tool-mating surface 124 of the wedge is vertical and arcuate except where it is flatted at 128, corresponding to the flatted cylindrical surface of the shank 22. As before, Allen screw 11 and dowel pins 19 secure the retainer block to the die show and an Allen head shoulder bolt 125 with a snap-ring in a groove above the threads, secures the conical wedge to the retainer block 120 so that tightening the conical wedge against the retainer block locks the shank 22 in the block and loosening the screw 125 releases the wedge and allows it to be moved downwards.

The other wedge 130 in the retainer block 120 is irregularly shaped. It has a planar wedge-inclined-surface the lower edge 131 of which is downwardly inclined at an angle θ, and the upper edge of the surface is indicated by dotted line 131 Surface 133 is vertical and arcuate, being partially cylindrical, curving outward; tool-mating surface 135 is vertical, arcuate and partially cylindrical, curving inward; and surface 134 represents the remaining vertical surfaces of the periphery which are shown as a partial polygon. From a practical point of view, one would choose the shape of the wedge which best suits his purpose for the task at hand, using the shape which is most economically cut.

In each of the foregoing embodiments it will now be evident that machining the wedge and retainer block to provide the tool cavity desired is the key to providing the reliability and precision not routinely available in any prior art tool and retainer combination used for a similar purpose. It will also be evident that the wedge may have plural inclined surfaces, if desired. Though the wedge, punch or die bushing, and retainer block with the appropriate tool cavity may be formed separately by machining them to the desired specifications, a preferred method is forming the tool cavity and wedge essentially simultaneously. This is done by a conventional traveling-wire electrical discharge machine (TW-EDM) in which a thin continuous wire-like elongate electrode is axially caused to travel or is transported from a supply reel to a wind-up (take-up) reel and a retainer block is disposed in juxtaposition with the traveling-wire electrode while electrical energy in the form of time-spaced electrical pulses is supplied across a machining gap formed between the traveling wire and the block in the presence of a dielectric fluid to effect a series of electrical discharges to remove material from the block. As material removal proceeds, the block is displaced relative to the axially transported wire electrode in a prescribed path to produce a desired cutting pattern in the block.

Conventional machines designed to execute the TV-EDM process are provided with a pair of support arms extending from a column mounted upright on a base of the machine, one of the support arms guiding the continuous wire electrode unwound from the supply reel into the machining region where the workpiece machining portion is located while the other guides the wire electrode having undergone the machining action continuously to the take-up reel. The axial transportation of the wire electrode is effected by controlled rotary drive comprising feed and brake roller arrangements which also act to stretch the moving wire guided between the support members under a sufficient tension to allow the wire electrode to travel smoothly and accurately in machining position relative to the workpiece. As a result, a block of hardened tool steel may be cut precisely, providing of course the machine is programmed appropriately. Of course, the wedge may be cut from a non-hardened alloy steel which may not need to be hardened, or which may be hardened later. The advantage of cutting the wedge from hardened steel is to minimize the distortion which may occur upon hardening. A machine which is well-adapted to machine the block as desired is a Mitsubishi FX10 which is preferably operated with a wire having a thickness of about 0.254 mm. (0.010"). Programming instructions for the machine are used conventionally, and being well known to those skilled in the art, need not be described in greater detail herein.

It will now be evident that the length of the tool being greater than the thickness of a retainer block in which it is to be held, it is not economical to cut the tool from the same block of hardened steel as the retainer block and wedge. For example, for a punch such as shown in FIG. 6 which is 7.62 cm. (3") long, the thickness of the retainer block is typically 2.54 cm (1"). Therefore, the tool, and preferably many tools, the same or different, are cut from a separate block of adequate longer dimension (7.62 cm) than the block from which the wedge and retainer block are cut (2.54 cm).

Figure 17:
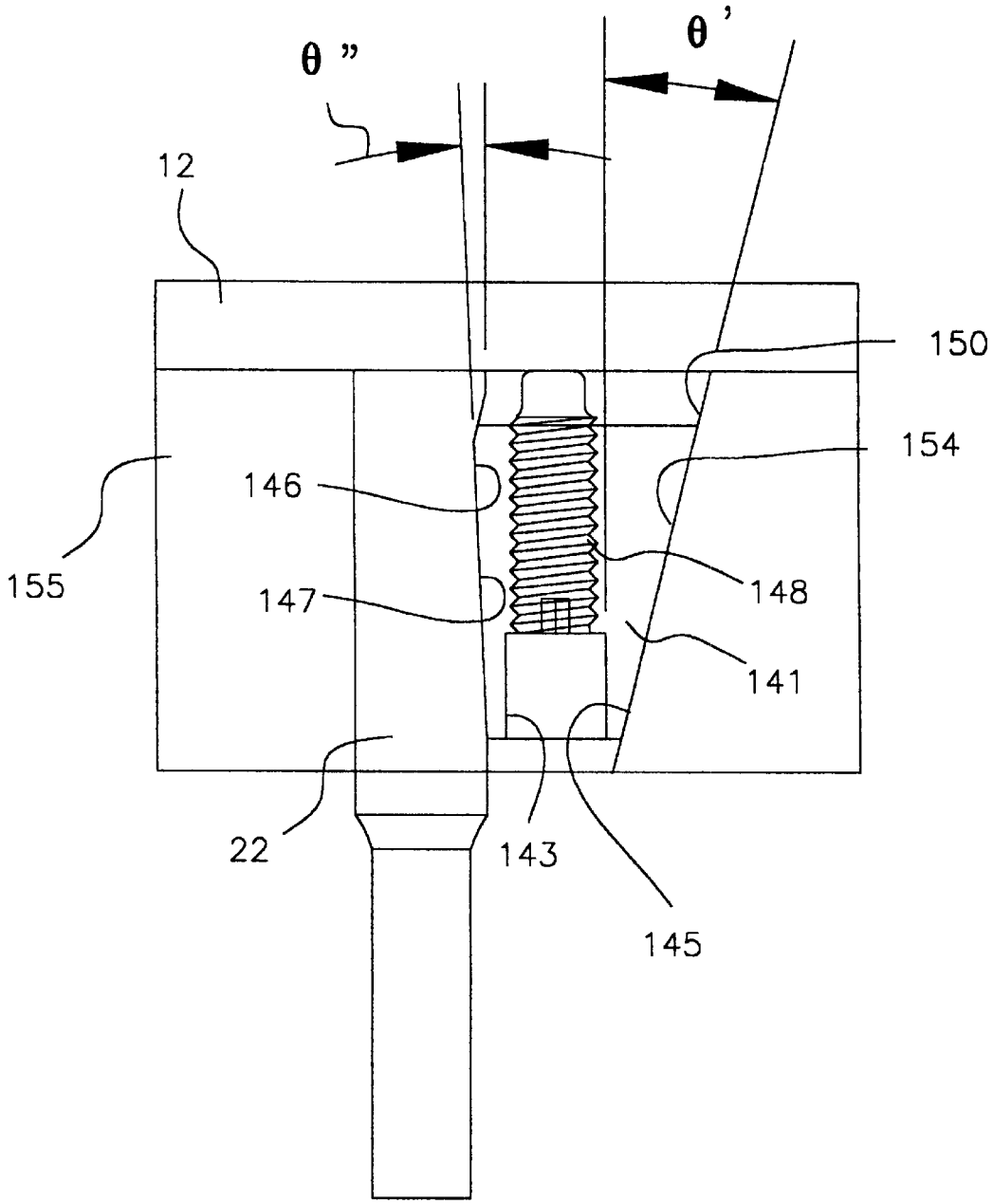
FIG. 17 is a a side elevational view, analogous to that in FIG. 11, showing an alternative embodiment for releasably securing the punch, in which embodiment wedge surfaces on opposed sides are oppositely inclined, in a substantially V-shaped configuration with diverging wedge surfaces at acute angles θ' and θ" respectively, each measured on either side from the upper vertical.

Referring to FIG. 17, there is illustrated an assembly particularly suited for extreme punching forces and related extreme stripping forces, typically requiring a headed punch which is captured in the backing plate before it is assembled to the upper die shoe. In this assembly, retainer block 155 is provided with tool-and-wedge cavity 150 having an inclined wall 154, and wedge 141 which has opposed inclined surfaces 145 and 146, cooperating with wall 154 and the surface 147 of the shank 22, each surface oppositely inclined and directed upwardly at acute angles θ' and θ" respectively, as shown measured on either side of the upper vertical line, as shown. With the oppositely and outwardly directed, upwardly acute angled surfaces, it is seen that an active wedging action is not obtained in both, the downward punching operation, as well as in the upward stripping direction. The punch can be withdrawn because the wedge surface 146 is angled downward and outward from the vertical line in the lower quadrant. To distinguish this V-shaped wedge 141 as positioned herein, from an inverted V-shaped wedge, wedge 141 is stated to have a first wedging surface inclined at an upwardly and outwardly acute angle, and an oppositely inclined second wedging surface inclined at an upwardly and outwardly acute angle, as measured from either side of the upper vertical line, to form a V-shaped wedge with diverging surfaces.

The tool-mating face 146 of the wedge is inclined at angle θ" and is adapted to closely receive the correspondingly inclined surface 147 of shank 22. The choice of angles is not narrowly critical but a relatively small angle θ" in the range from 0.25° to about 10°, preferably 1.5° to 3° is convenient to remove and replace the punch without removing the retainer block 155 from the backing plate 12. The angle θ' is preferably in the range from 3 to 5 times larger than angle θ", typically in the range from 0.75° to 30°, most preferably from 4.5° to 10°. Since the shank is cylindrical, the inclined surface 147 is preferably arcuate; however, the surface 147 may be planar and the wedge surface 146 correspondingly planar. Wedge 141 is provided with a stepped through-bore 143 the upper portion of which is threaded and into which an Allen screw 148 is inserted so as to protrude through the upper surface of the wedge and be biased against the lower surface of the backing plate 12.

Because the surfaces 145 and 146 of the wedge are both tapered, the wedge can only be inserted through the upper opening of the cavity 150 before the block 150 is secured to the backing plate. When the wedge 141 is pushed upward towards the backing plate, enough clearance is provided for the shank 22 of the punch to be inserted and held against wedge surface 146. When the Allen screw is tightened against the backing plate, the wedge tightly locks the shank in position. To remove the punch, the Allen screw 148 is backed out, a dowel inserted in the lower portion of the stepped bore 143, and the impact of a hammer drives the wedge up against the backing plate to release the punch.

The wedge may be removed after removing the punch only if opposed sides of the wedge cavity are not oppositely directed and acutely inclined, as for example shown in FIG. 12, where only one side of wedge 105 is inclined.

Figure 17A:
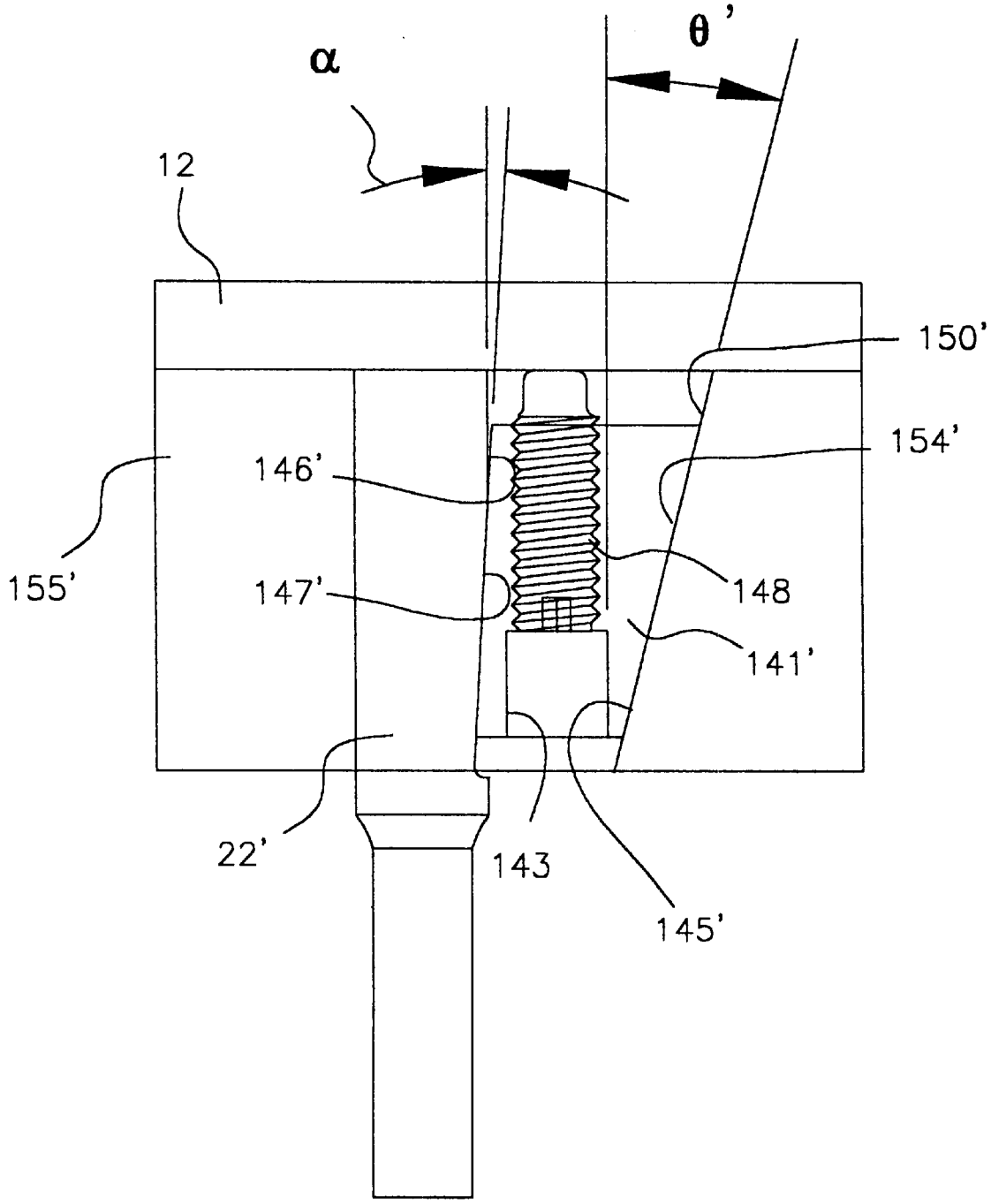
FIG. 17A is a a side elevational view, showing another embodiment for releasably securing the punch, in which embodiment wedge surfaces on opposed sides are similarly inclined, in a substantially V-shaped configuration with non-diverging wedge surfaces at acute angles θ' and α' respectively, each measured on the same side from the upper vertical.

Referring to FIG. 17A is a more preferred embodiment of a V-shaped wedge both surfaces of which are angled in the same direction. The retainer block 155' is provided with tool-and-wedge cavity 150' having an inclined wall 154', and wedge 141' which has opposed inclined surfaces 145' and 146', cooperating with wall 154' and the surface 147' of the shank 22', each surface inclined in the same direction, and directed upwardly at acute angles θ' and α' respectively, measured on the same side of the upper vertical line, as shown for θ'; for convenience the angle α' is shown as the corresponding angle of intersection, measured in the third quadrant, from the lower vertical line. With the outwardly similarly directed, upwardly acute angled surfaces, it is seen that an active wedging action is obtained in the upward stripping direction because the angled surface 146' obstructs withdrawal of the punch; an active wedging action is also obtained in the downward punching operation because the angled surface of the wall 154' obstructs downward movement of the punch. The punch cannot be withdrawn because the wedge surface 146' is angled downward and outward from the lower vertical line. To distinguish this V-shaped wedge 141' as positioned herein, from the prior V-shaped wedge 141, and an inverted V-shaped wedge, wedge 141' is stated to have a first wedging surface inclined at an upwardly and outwardly acute angle, and an oppositely inclined second wedging surface also inclined at an upwardly and outwardly acute angle, both angles measured from the same side of the vertical line in the first quadrant. Wedge 141' may also be referred to as having inclined non-diverging surfaces relative to one another.

Figure 18:
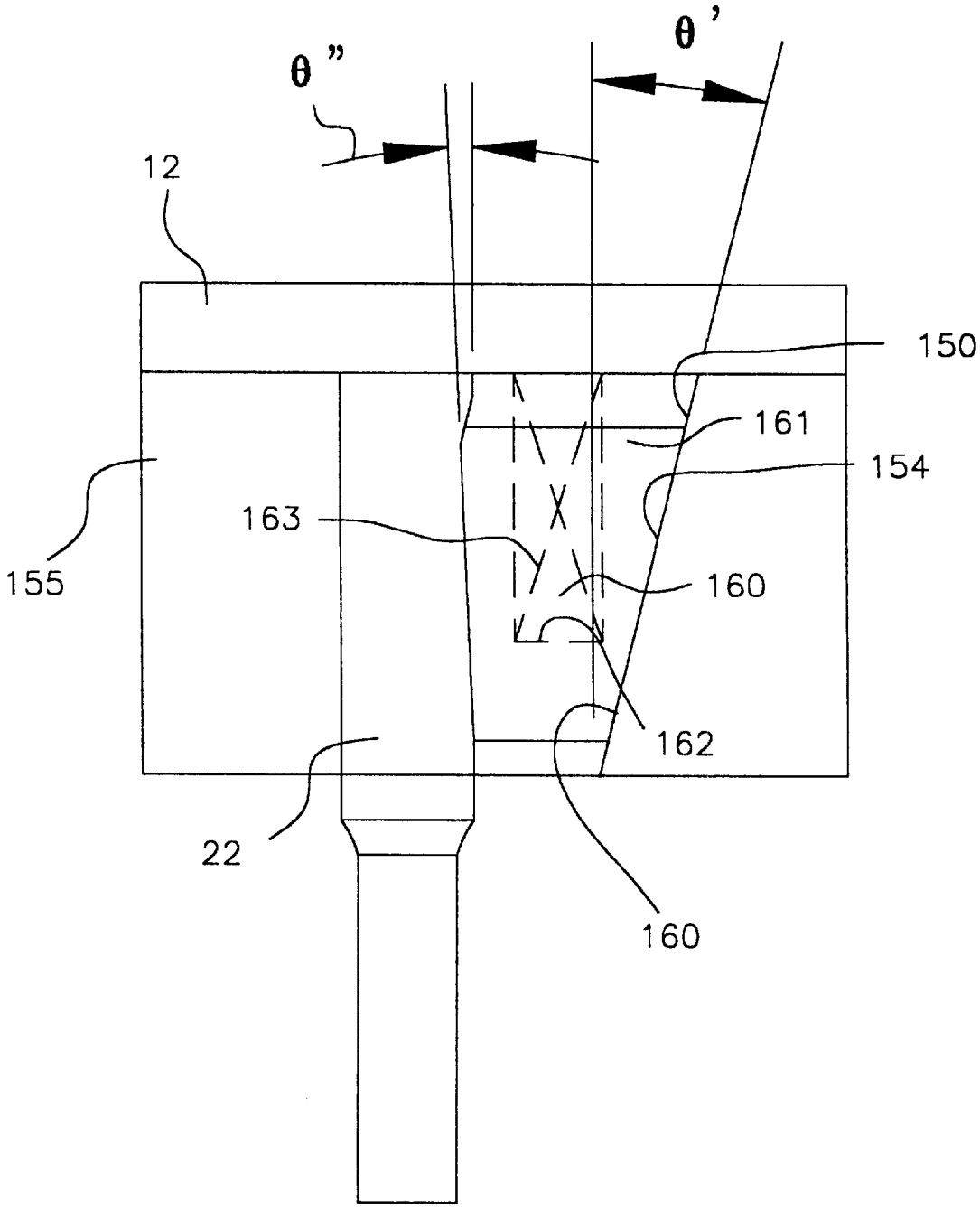
FIG. 18 is a a side elevational view, analogous to that in FIG. 17, showing an alternative embodiment in which wedge surfaces on opposed sides are oppositely inclined, as in FIG. 17, but the wedge is urged away from the backing plate with a spring.

Referring to FIG. 18, there is shown an assembly analogous to that shown in FIG. 17, with a wedge 161 having the same oppositely inclined opposed surfaces directed upwardly and outwardly at acute angles θ' and θ", as shown, except that wedge is provided with a closed bottom spring cavity 160 against the bottom 162 of which is biased a captive biasing means, preferably a helical spring 163, or Z-shaped strip of spring steel, or any compressible member with a spring constant high enough to force the bottom of the wedge downwards and lock the shank 22 of the punch in retainer block 155. As before, the wedge 161 is inserted through the upper opening of the cavity 150, and cannot be removed without removing the retainer block 155 from the backing plate 12. To remove the punch, a dowel is inserted in the lower end of the cavity 150 and driven upwards to overcome the pressure of the spring, releasing the punch. The punch is replaced by urging the wedge 161 upwards and inserting the shank of the punch to abut the backing plate 12.

Figure 18A:
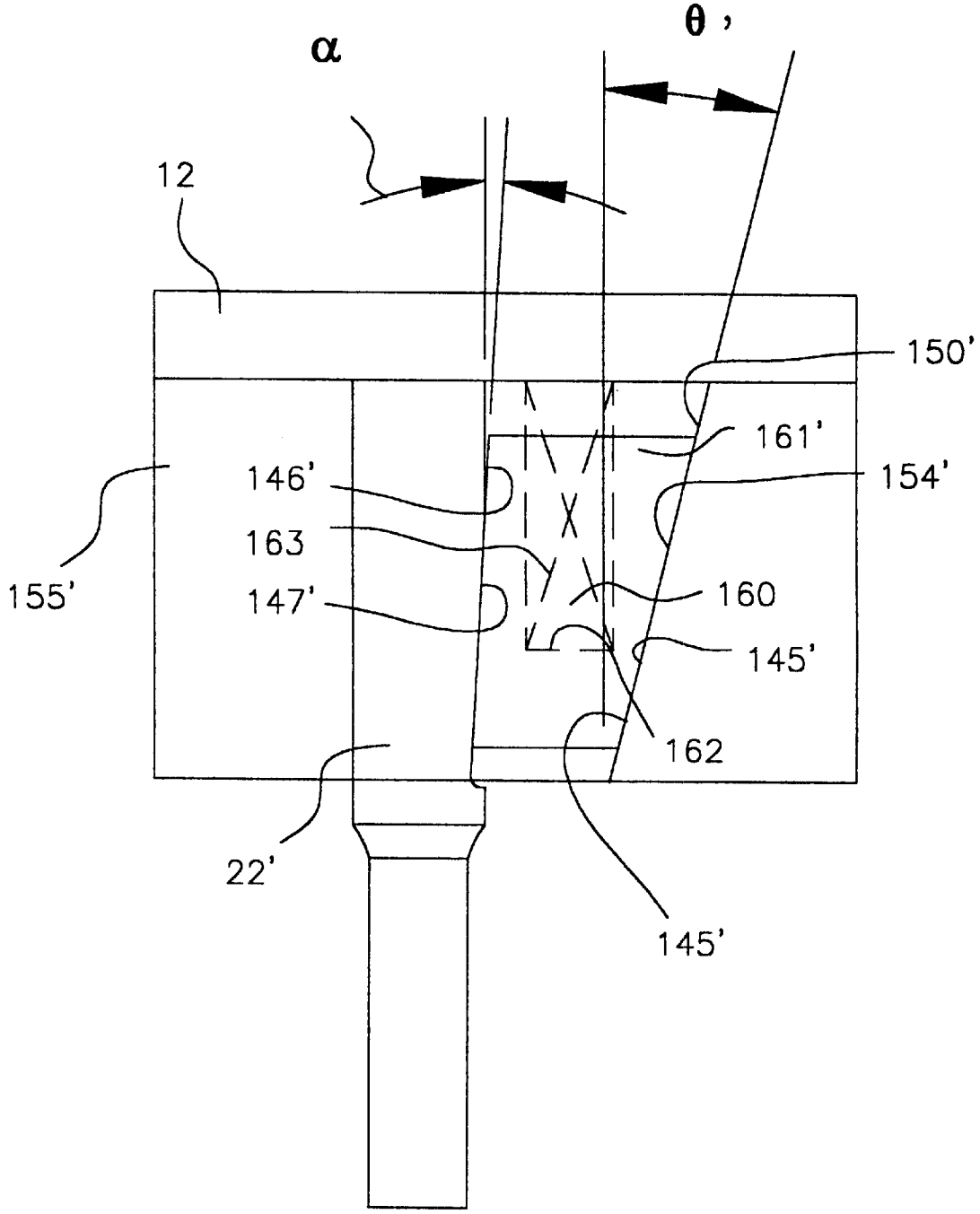
FIG. 18A is a a side elevational view, analogous to that in FIG. 18, showing an alternative embodiment in which wedge surfaces on opposed sides are similarly inclined, in a substantially V-shaped configuration with non-diverging wedge surfaces at acute angles θ' and α' respectively, each measured on the same side from the upper vertical oppositely inclined, as in FIG. 17A, but the wedge is urged away from the backing plate with a spring.
Figure 19:
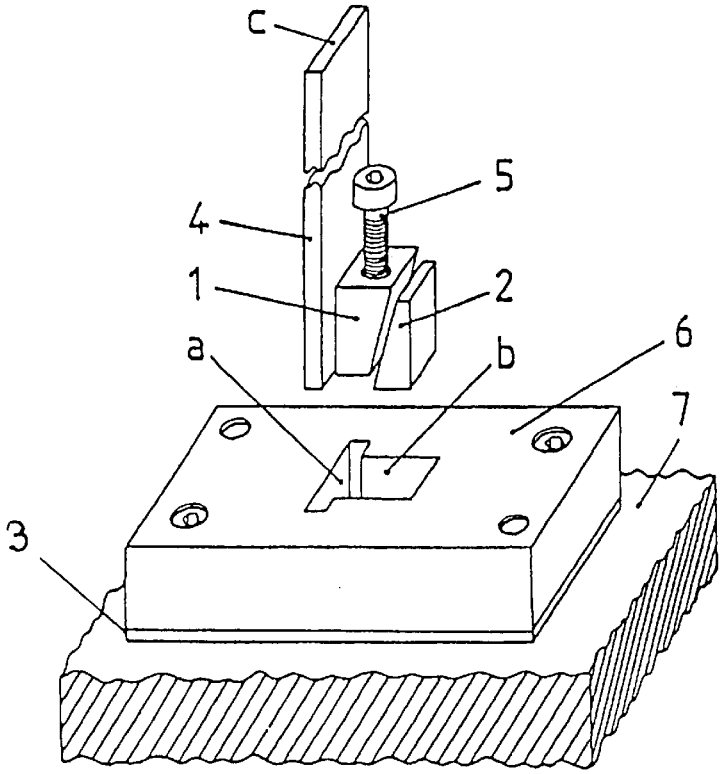
FIG. 19 PRIOR ART
FIG. 19 is a prior art assembly comprising a pair of complementary wedges forming a parallelpiped, one of which wedges is directly attached to the upper die shoe, the wedges serving the same general purpose as the wedge in the assembly of this invention.
Figure 20:
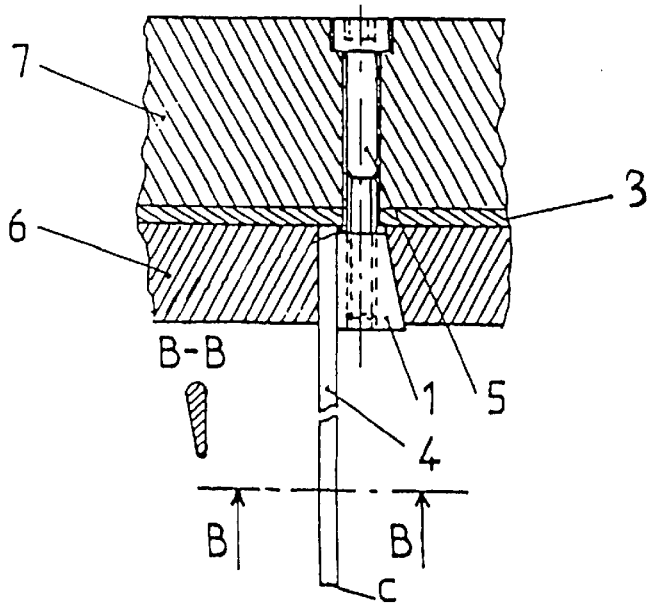
FIG. 20 PRIOR ART
FIG. 20 is a cross-sectional view of another embodiment of the prior art embodiment using a single wedge.

Referring to FIG. 18A is a more preferred embodiment of a V-shaped wedge analogous to the wedge shown in FIG. 17A, both surfaces of which wedge are angled in the same direction. The retainer block 155' is provided with tool-and-wedge cavity 150' having an inclined wall 154', and wedge 161' which has opposed inclined surfaces 145' and 146', cooperating with wall 154' and the surface 147' of the shank 22', each surface inclined in the same direction, and directed upwardly at acute angles θ' and α' respectively, measured on the same side of the upper vertical line, as described for FIG. 17A.

The effectiveness of the assembly illustrated in FIGS. 17, 17A, 18 and 18A is demonstrated by the following operation. A laminar plate of mild carbon steel 9.52 mm (0.375") thick is placed above a downwardly relieved (flared) die bushing having an upper diameter of 12.7 mm (0.500") and a lower diameter of 15.24 mm (0.600"), which clearance between the top and the bottom is conventional and typically 20% of the thickness of the stock being punched. The die bushing is a single-angled wedge as shown in FIG. 15D. A punch 0.500" in diameter is held in the assembly illustrated in FIG. 17A and several holes are punched, one after the other, through the plate with a 90-ton C-frame punch press made by Fercute Co. Each hole is 0.500" in diameter; the punched blank, at its upper punch-contacting surface is 14.22 mm (0.500") and at its lower surface is 0.560" in diameter. In every instance, the punch remained in the retainer block during the stripping motion.

In another operation, the same thickness of laminar mild steel plate is placed over a die bushing with a double-angled wedge (as shown in FIG. 15C) the die cavity for the punched blank having the same upper and lower diameters, each being 0.500" and providing no conventional clearance. The same 0.500" diameter punch used before is then used in the same 90-ton press to punch several holes through the 0.375" thick steel sheet. Each hole is 0.500" in diameter; the punched blank, at its upper punch-contacting surface is 0.500" and at its lower surface is 0.560" in diameter. In every instance the punch was stripped from the steel without being loosened in its retainer block.

Having thus provided a general discussion, described the overall combination of tool and wedge means in detail and illustrated the invention with specific examples of the best mode of carrying out the process, it will be evident that the invention may be incorporated in other tool constructions, several of which are described. The wedge lockable tool has provided an effective solution to an age-old problem. It is therefore to be understood that no undue restrictions are to be imposed by reason of the specific embodiments illustrated and discussed, and particularly that the invention is not restricted to a slavish adherence to the details set forth herein.

I claim:

1. A tool construction comprising:

a tool support structure defining a substantially planar support surface, said support surface comprising a planar backing plate surface of a punch press;

a tool retention structure comprising a tool retainer block supported on said planar backing plate surface of said tool support structure;

said tool retainer block defining a cavity for receiving a tool, said cavity including a surface extending into said tool retainer block in a vertical direction substantially perpendicular to said support surface, said cavity comprising a closed end adjacent said backing plate and an open end opposite said closed end, and said surface of said cavity defining a vertical cavity wall and an opposing inclined cavity wall angled outwardly from said vertical cavity wall in a direction extending from said open end toward said closed end of said cavity;

a tool located in said cavity and defining a vertical tool center line extending into said cavity from said open end to said closed end, said tool including a vertical tool surface engaged with said vertical cavity wall and an opposing inclined tool surface angled outwardly from said vertical tool center line; and a wedge structure including a first wedging surface inclined outwardly from said vertical center line and cooperating with said inclined tool surface, and an opposing second wedging surface inclined outwardly from said vertical center line and cooperating with said inclined cavity wall.

2. The tool construction of claim 1 including biasing means for biasing said wedge structure in a direction substantially parallel to said vertical center lineaway from said planar backing plate surface of said tool support structure.

3. The tool construction of claim 2 wherein said biasing means extends through said wedge structure and extends from said wedge structure into pressure contact with a surface at said closed end of said cavity.

4. The tool construction of claim 3 wherein said biasing means comprises a threaded fastener threadably engaged with said wedge structure and non-threadably contacting said surface at said closed end of said cavity.

5. The tool construction of claim 1 wherein said wedge structure is unattached directly to the tool support structure, and including fastening means cooperating with the wedge structure for releasably locking said tool in said cavity.

6. The tool construction of claim 1 wherein said first and second wedging surfaces are inclined at first and second angles relative to said vertical center line, said first angle being different from said second angle.

7. The tool construction of claim 6 wherein said first angle is less than said second angle.

* * * * *